US005542816A

United States Patent [19]

Wallin

[11] Patent Number: 5,542,816

[45] Date of Patent: Aug. 6, 1996

[54] METHOD AND APPARATUS FOR REORIENTING BLANKS WHILE FEEDING INDIVIDUAL BLANKS FROM A STACK TO AN ERECTING MACHINE

[75] Inventor: Kay Wallin, Halmstad, Sweden

[73] Assignee: Sprinter System AB, Sweden

[21] Appl. No.: 424,305

[22] PCT Filed: Oct. 27, 1993

[86] PCT No.: PCT/SE93/00889

§ 371 Date: Apr. 26, 1995

§ 102(e) Date: Apr. 26, 1995

[87] PCT Pub. No.: WO94/10074

PCT Pub. Date: May 11, 1994

[30] Foreign Application Priority Data

Oct. 27, 1992 [SE] Sweden ..... 9203156

[51] Int. Cl.[6] ..... B65G 59/08

[52] U.S. Cl. ..... 414/798.9; 414/786; 271/11; 271/107; 271/31.1

[58] Field of Search ..... 414/798.9, 786; 53/453, 456, 458; 493/167; 271/11, 12, 107, 31.1

[56] References Cited

U.S. PATENT DOCUMENTS

| | | | |
|---|---|---|---|
| 2,819,073 | 1/1958 | Murray | 271/11 |
| 3,767,185 | 10/1973 | Newsome | 271/11 |
| 4,484,735 | 11/1984 | Goi . | |
| 4,822,234 | 4/1989 | Johnson et al. | 271/31.1 |
| 5,025,834 | 7/1991 | Boldrini et al. | 271/11 |
| 5,177,930 | 1/1993 | Harston et al. | 493/167 |
| 5,429,346 | 7/1995 | Andersson et al. | 271/11 |

FOREIGN PATENT DOCUMENTS

| | | | |
|---|---|---|---|
| 2211490 | 5/1989 | United Kingdom | 271/31.1 |

*Primary Examiner*—Karen B. Merritt
*Assistant Examiner*—Douglas Hess
*Attorney, Agent, or Firm*—Ostrolenk, Faber, Gerb & Soffen, LLP

[57] ABSTRACT

A method and apparatus is disclosed for conveying individual blanks, one at a time, from a stack of blanks in a magazine to a form chamber in an erecting machine. The magazine includes bottom and side guides and a conveyor for moving the blanks into a pickup position. A suction cup device is utilized to grip an upper portion of the blank in the pickup position and swing the blank into engagement with a bolster roller set. A segment device having a curved surface is also disclosed for coacting with the bolster roller for swinging the blank from a substantially vertical position to a substantially horizontal position for conveying into an erecting machine.

6 Claims, 3 Drawing Sheets

Fig. 1
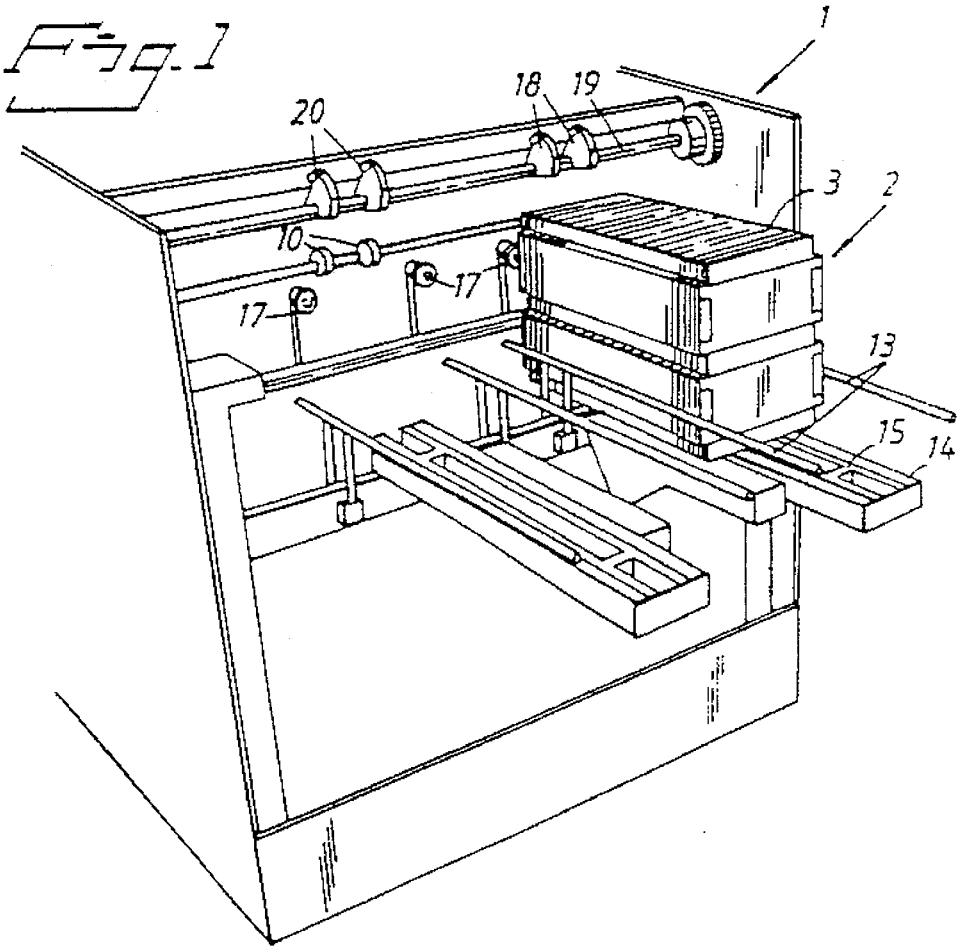
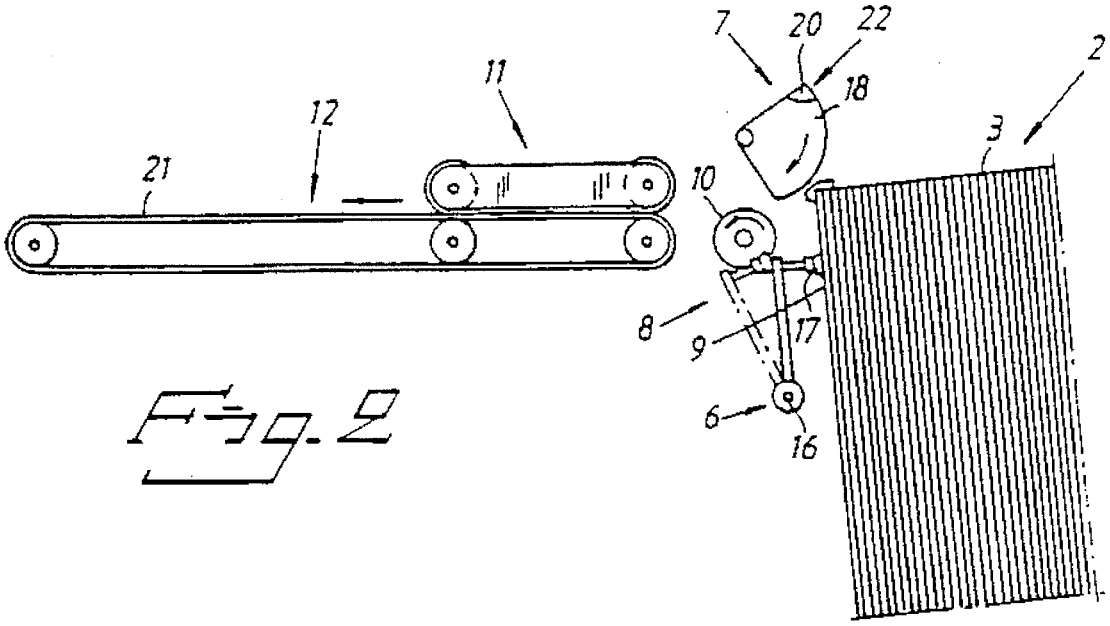
Fig. 2

METHOD AND APPARATUS FOR REORIENTING BLANKS WHILE FEEDING INDIVIDUAL BLANKS FROM A STACK TO AN ERECTING MACHINE

The present invention relates to a method and an arrangement for conveying blanks in an erecting machine from a stack of blanks, which are intended to be picked one at a time from the stack and conveyed further to a form chamber in an erecting machine, where the blank is formed into a container with the aid of a plunger. The magazine includes bottom and side guides, as well as means for conveying the blanks, upstanding on edge, forward to the exit or delivery end of the magazine. There are also means for conveying the blanks, after they exit from the machine, to the form chamber, where they are formed into containers with the aid of the plunger.

In the types of erecting machines at present on the market, there are considerable problems with the mechanisms transferring the blanks from the magazine and advancing them into the erecting machine itself, i.e. there are stoppages in the flow of blanks, or two or three blanks are advanced simultaneously, thus causing machine downtime. Another problem is that most erecting machines have magazines, where the blanks are stacked one on top of the other, resulting in that filling the magazine is both difficult and laborious.

The object of the present invention is to eliminate the drawbacks burdening previously known apparatus of the kind mentioned above, and to achieve a method and an arrangement in erecting machines for conveying blanks from a magazine such as to take place without unnecessary downtime, as well as at very high machine speeds, while the arrangement for carrying out the method has apparatus having a construction which is simple and reliable. The features distinguishing the invention are disclosed in the accompanying claims.

By reason of the present invention there has now been provided a method and an arrangement of the kind mentioned above, for conveying blanks that are stacked on edge in a magazine. With the blank picking apparatus included in the inventive arrangement the magazine may now be placed at working height, signifying several advantages from the ergonomic aspect, particularly for the personnel who daily attend the machine. The picking apparatus includes at least one suction cup device, the cup of which attaches itself to the blank nearest to it in the magazine, the device drawing the blank from the magazine such as to give the blank a curved configuration, while taking the upper portion of the blank into engagement against a bolster roller. Also part of the picking apparatus is a swinging segment device, which moves such as to press a portion of the blank against the bolster roller while moving at a peripheral speed, which is the same as that of the roller, the device and roller thus urging the blank to an advancing means, e.g. a set of rollers. By this arrangement the blank is re-oriented from an upstanding attitude in the magazine to a horizontal attitude for advancing to the form chamber in the erecting machine. With this horizontal orientation the blank is urged downwards in the form chamber using a plunger, thus forming the packaging container. Only one blank at a time is picked by the inventive blank picking apparatus, since the intrinsic resistance to bending of the blanks causes the blank next to the one being withdrawn to separate from it as the suction cup device draws the blank it is attached to into a curved configuration, the problem caused by two or more blanks being picked simultaneously thus being eliminated. Due to the simplicity of the apparatus, where few moving parts are required for the actual picking and translation of the blanks from vertical to horizontal orientation, very high machine speeds can be maintained, and of course large capacity as a result.

The invention will now be described in more detail below, using a preferred embodiment example, and with reference to the accompanying drawings, where:

FIG. 1 is a perspective view of one end of an erecting machine operating with two magazines, of which the one to the right is shown loaded with blanks on edge, the inventive blank picking apparatus being placed at the blank exit end of the magazine.

FIG. 2 is a schematic side view of the inventive arrangement for advancing the blanks, and from which may be understood the blank picking principle.

Figure 3:
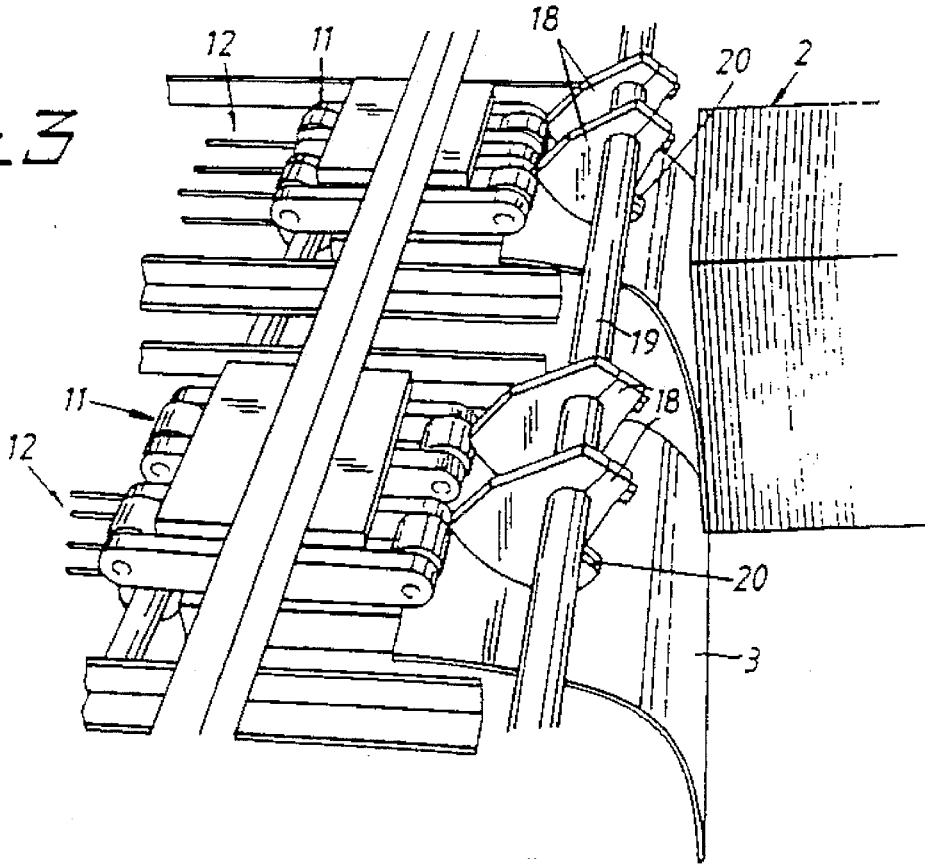
FIG. 3 is an oblique view from above, showing part of the arrangement in FIG. 1 for picking and advancing the blanks.
Figure 4:
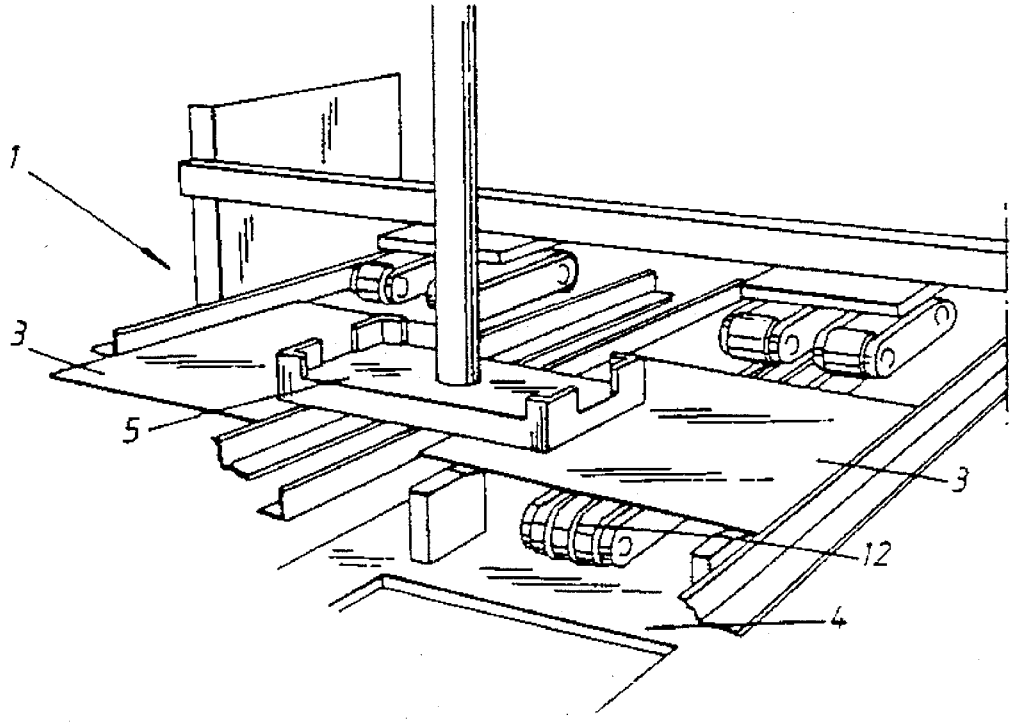
FIG. 4 is a perspective view of the other end of the machine in FIG. 1, a blank being in a position partially covering the form chamber, and with the plunger above it.

As will be seen from the drawings, the object of the arrangement, according to a preferred embodiment, is to convey packaging blanks 3, stacked on edge in at least one magazine 2 at working height, to a form chamber 4 in an erecting machine 1, the blanks being in a horizontal position above the chamber for erection by a plunger 5. Immediately in front of the magazine exit 6, and at its upper portion 7, there is apparatus which includes a device 8 including a vacuum-operated suction cup. The device is pivotably mounted such as to enable it to urge the blank upper portion 9 against at least one bolster roller 10, which is situated between the magazine 2 and at least one advancing roller set 11 situated above, and in association with, a conveyor 12.

The magazine 2 itself is somewhat downwardly sloping in a direction towards its exit 6, and is disposed at working height on the erecting machine 1. Packaging container blanks 3 are placed on edge, one against the other, in the magazine and are laterally positioned with the aid of guides 13, while resting on a bottom guide 14, which in this case includes means 15 for advancing the blanks 3 forwards to the magazine exit 6 or discharge end. The suction cup device 8 is pivotably mounted on a shaft 16, about which it swings between two positions for providing the outward flexing of one blank 3 at a time. When the device 8 is in a position for extracting a blank its suction cup 17 is put under vacuum for attracting the outmost blank, giving it an outward curvature as the suction cup 17 moves to its outwardly swung position, with the blank urged against the bolster roller 10. Vacuum is released at this stage, and the suction cup releases the blank, which can then be advanced over the roller 10 with the aid of at least one segment device 18 pressing against the blank from above. In the embodiment example illustrated in FIGS. 1–4, there are two such devices 18 for each blank, and they are adapted to swing with the aid of a shaft 19, which extends above the bolster rollers 10.

The blank 3 is thus advanced from its substantially vertical state, and is passed over the rollers 10 with the aid of segment devices 18 in an arcuate movement, and into horizontal orientation as it coacts with the roller set 11. In certain cases, when the blank is coacting with the roller set 11, the advancing speed may be increased, which enables greater flexibility in the sizes of blank format that can be used. A segment device 18 is illustrated to an enlarged scale and in more detail in FIG. 6. To ensure that the blank is not torn apart when it is advanced with the aid of the roller set 11 at a greater speed, the segment devices 18 are each provided at its rear edge 22 with a spring biassed trailing portion 20, which can move in an upward direction to release or reduce its pressure against the blank 3 when the roller set coacts in advancing the blank at a speed which can be greater than it is over the bolster rollers 10. The portion 20 at the rear or trailing edge 22 is pivotable about a pin 23, and is kept in its normal position with its curved surface 24' in line with the curved surface 24 of the segment device 18 with the aid of spring bias, e.g. from a compression spring 25. For obtaining less pressure against the blank, the portion 20 will move into the position shown by dashed lines in FIG. 6. The result of this mechanism is the avoidance of excessive tensile stress in a blank as it starts to coact with the roller set 11 for advancement, which can be at a greater speed than the blank had before.

Figure 5:
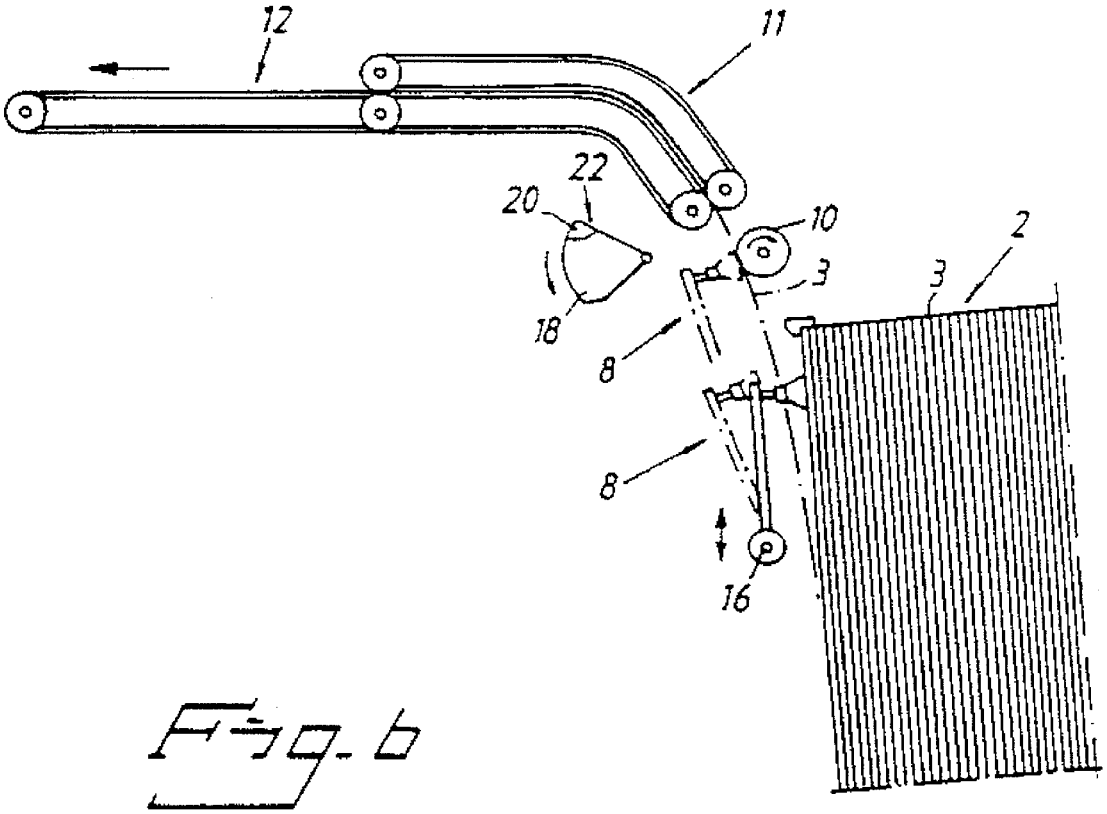
FIG. 5 is a schematic side view of another embodiment, from which may be understood in principle the picking and apparatus for the blanks.

In the embodiment example of the inventive arrangement for conveying packaging blanks from a stack of them in the magazine 2 to the erecting chamber, as illustrated in FIG. 5, the suction cup device 8 is also movable in a substantially vertical direction, from a lower blank picking position to an upper blank releasing position. In the former, where the upper portion 9 of the blank 3 engages the bolster rollers 10, vacuum is released simultaneously as the segment device 18 has swung into position for urging the blank against the bolster rollers 10, for taking the blank further to the roller set 11, from whence the blank is further advanced in a horizontal attitude and via the conveyor 12 up to the form chamber 4 of the erecting machine 1.

In order to increase friction over the bolster rollers 10, as well as on the segment devices 18, their respective curved surfaces may be provided with friction-increasing material, e.g. rubber. The conveyor 12 in coaction with the roller set 11 takes the blanks to the form chamber 4 in the machine 1. In the present case, the conveyor includes a plurality of hollow bands 21 having holes communicating with vacuum, for increasing friction with the conveyed blanks. When the blanks 3 have come to the form chamber 4 in the machine 1 they are conventionally erected with the aid of the plunger 5, such as to form a packaging container, which is then ejected onto a delivery conveyor disposed under the form chamber 4, this conveyor also being at working height.

Figure 6:
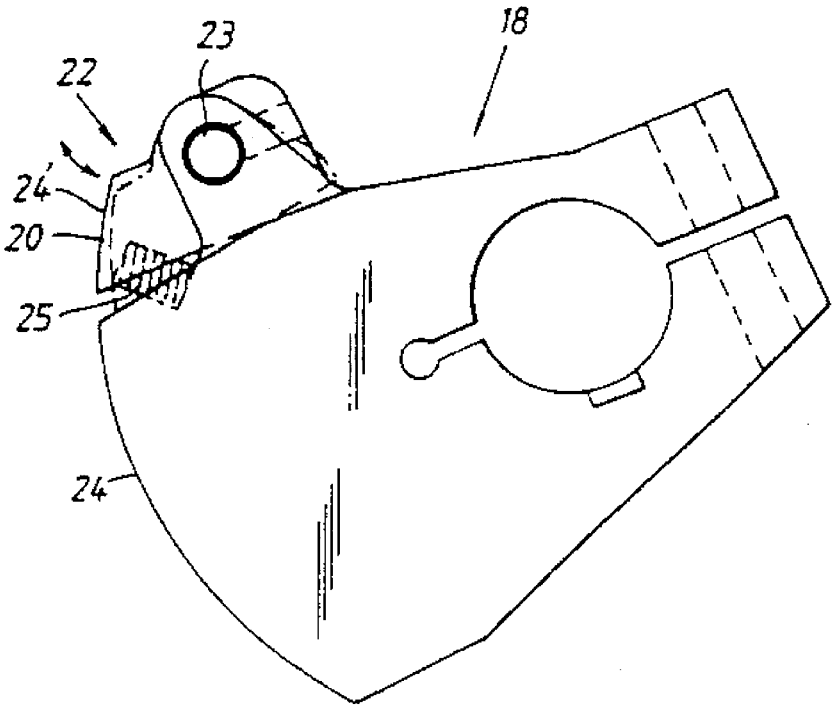
FIG. 6 is an enlarged side view of a segment device, seen from the other side of the one illustrated in FIG. 1, and intended for coaction with a bolster roller.

The method of conveying the blanks from the magazine 2 to the form chamber 4 in the machine 1 is carried out as follows. One blank 3 at a time is taken from the exit end 6 of the magazine 2 with the aid of the suction device. 8, the suction cup 17 of which attaches itself by vacuum to the upper portion 9 of the blank such as to flex it outwards, for subsequently bringing, as illustrated by the example in FIG. 5, the upper portion of the blank 3 into engagement with the bolster rollers 10 situated in front of the advancing roller set 11. The amount of outward swing of the blank upper portion 9 may be between 10° and 45° from a vertical plane, and is preferably 15°. When the blank 3 engages the bolster rollers 10, the segment devices 18 are given their swinging movement, which presses the blank 3 against the rollers simultaneously as the swinging movement is synchronous with the roller rotation. The blank 3 is thus advanced between roller and segment simultaneously as it is flexed over the rollers 10, according to the embodiment example illustrated in FIGS. 1–4, and thus assumes a substantially horizontal position for advancing to the following roller set 11. In the other embodiment example illustrated in FIG. 5, flexing the blank 3 to its horizontal attitude preferably occurs within the extension of the roller set 11. In order to obtain as great a flexibility in format size as possible, the advancing speed of the set 11 may be greater than that over the rollers 10. With this in mind, the segment device 18 may be provided with the upwardly spring biassed trailing portion 20. When the blank 3 comes into coaction with the roller set 11, the spring biassed portion 20 of the segment device 18, see FIG. 6, is in engagement with the blank 3 and is pressing it against the rollers 10, simultaneously as the pressure, by reason of the resilient property of the trailing portion 20, enables the blank to be drawn into coaction with the roller set 11 at a greater speed than the blank had over the bolster rollers 10. In other words, the nip between the bolster rollers 10 and the segment devices 18 is implemented such that the blank 3 may be drawn through it due to reduction in friction. After passing the roller set 11 the blanks 3 are further advanced by the conveyor 12 up to the form chamber 4 in the erecting machine 1, and in the embodiment example in question this conveyor 12 is provided with the mentioned hollow bands 21. These have holes that can be put under vacuum, so that friction between said bands 21 and the blanks 3 conveyed on them will be as great as possible. Other conveying means may also be used, of course. The blank 3 is then positionally fixed above the form chamber 4, after which the plunger 5 erects the blank 3 while urging it downwards onto a conveyor (unillustrated on the drawing) situated under the form chamber 4, this conveyor then discharging the erected blanks in the form of packaging containers from the erecting machine 1.

I claim:

1. Method of conveying packaging blanks from a stack of blanks (3) placed in at least one magazine (2), said magazine being provided with an exit end having an upper portion, said blanks including a foremost blank and being picked one at a time from the magazine (2) and conveyed further to a form chamber (4) in an erecting machine (1), where said blanks are formed into packaging containers with the aid of a plunger (5), whereby the foremost blank (3) of said stack of blanks (3) on edge and one against the other in the magazine (2) is gripped at its upper portion (9) with the aid of vacuum by at least one suction cup device (8), and after being swung outwards is brought into engagement with a bolster roller (10) having a rotational speed, which is situated in association with said upper portion (7) of the exit end of the magazine (2) and immediately in front of an advancing roller set (11) having an advancing speed, the blank (3) in this position being pressed against the bolster roller (10) by at least one segment device (18), which is caused to swing down onto the blank (3) to cause said blank to swing outward, said segment device swinging with the same rotational speed as the bolster roller (10) with the blank pressed between them, characterized in that, during the outward swing of the upper portion (9) of the blank (3), the suction cup device (8) brings it into direct contact against said bolster roller (10), situated immediately in front of the magazine (2) and mainly in a level with and in direct association with the advancing roller set (11) and in which position the segment device (18) from above presses the blank (3) against the bolster roller (10), such that the blank (3) is advanced forward and flexed over the bolster roller (10) from the substantially vertical attitude of said blank in the magazine (2) to a substantially horizontal attitude during the advance into the roller set (11) in further advancing the blank (3) to the form chamber (4) in the erecting machine (1); said segment device (18) having a rear portion (20), which resiliently presses against the blank (3) such as to permit an increase in the speed of the blank (3) when it is advanced by the advancing roller set (11), simultaneously as said portion (20) moves resiliently to release the blank (3).

2. Method as claimed in claim 1, characterized in that the advancing speed is greater within the roller set (11) than over the bolster roller (10) for achieving greater flexibility in format size.

3. Method as claimed in claim 1, characterized in that after the roller set (11) the blanks (3) are conveyed to the form chamber (4) by a conveyor (12) provided with hollow bands (21), which are provided with holes in communication with vacuum for increasing friction between the blanks (3) and said conveying means (21).

4. Arrangement as claimed in claim 1, characterized in that a conveyor (12) is provided in association with the roller set (11) for conveying the blanks (3) forward to the form chamber (4) in the erecting machine (1), said conveyor (12) including conveying means comprising hollow bands (21) having holes, which are in communication with vacuum for increasing friction against the blanks (3) carried by them.

5. Arrangement in an erecting machine, including apparatus for picking packaging blanks from at least one magazine, said blanks having an upper portion, said apparatus being (2) provided with bottom and side guides (13, 14) as well as means (15) for advancing the blanks (3) upstanding and on edge in the magazine to its exit end (6), and advancing apparatus (10, 11, 12) for further conveyance of the blanks, after their removal from the magazine, to a form chamber (4) in the erecting machine (1), where the blanks are formed into packaging containers with the aid of a plunger (5), whereby after, and in association with, the exit end (6) of the magazine (2) there is at least one suction cup device (8) operating by vacuum, the device being adapted to swing out the upper portion (9) of the blank (3) and bring it into engagement against at least one bolster roller (10) situated in association with at least one advancing roller set (11) provided in the advancing apparatus (10–12) and at least one device (18) coacting with said bolster roller (10) such as to advance between them the blank (3), characterized in that said bolster roller (10) is situated immediately in front of the magazine (2) and mainly in a level therewith and in direct association with the advancing roller set (11) and in that said device (18), device coacting with said bolster roller (10) consists of a segment device having a curved surface, said device situated with its swing axis mainly straight above said bolster roller (10) to use a swing movement to feed the blank (3) from a substantially vertical attitude in the magazine (2) and flex it around said bolster roller (10) to a substantially horizontal feed direction to further advance to the form chamber (4) in the erecting machine (1), said segment device (18) having a rear portion (20), which is spring biassed in an upward direction for releasing or decreasing the pressure against the blank (3) when the latter is in coaction with the advancing roller set (11).

6. Arrangement as claimed in claim 5, characterized in that the bolster roller (10) has its curved surface disposed for high friction, and is preferably rubber covered, as with the curved surface of the segment device (18).

* * * * *